United States Patent [19]

Butler et al.

[11] 4,270,483

[45] Jun. 2, 1981

[54] PRINTING COATER

[76] Inventors: Denton G. Butler, 23 Halladier Pl., Islington, Ontario, Canada, M9B 2H4; Andrew W. Lester, 30 Innis Cresc., Richmond Hill, Ontario, Canada, L4C 5K2

[21] Appl. No.: 972,688

[22] Filed: Dec. 26, 1978

[51] Int. Cl.[3] ..... B05C 11/00

[52] U.S. Cl. ..... 118/46; 101/217; 118/206; 118/258; 118/262; 118/264; 118/261

[58] Field of Search ..... 118/258, 46, 264, 206, 118/261, 262; 101/201, 451, 217

[56] References Cited

U.S. PATENT DOCUMENTS

| | | | |
|---|---|---|---|
| 1,880,070 | 9/1932 | Becker | 118/46 |
| 3,397,675 | 8/1968 | de Ligt | 118/258 |

FOREIGN PATENT DOCUMENTS

| | | | |
|---|---|---|---|
| 763417 | 4/1934 | France | 118/46 |
| 564566 | 10/1944 | United Kingdom | 118/46 |

*Primary Examiner*—Edward C. Kimlin

[57] ABSTRACT

An apparatus is provided for attachment to the downstream end of a conventional offset lithographic printing press for in-line coating of the printed work issuing from the press, with water-based polymer coatings, to protect the printing ink as the printed matter sets and hardens. The apparatus includes a pick-up roller which picks up liquid coating composition from a reservoir structure, a cylindrical applicator roller to which the coating composition is transferred, the apparatus being mounted on the frame of the press so that the applicator roller of the apparatus can bear against the blanket roll of the printing press and transfer the coating composition to the blanket roll as the press operates. The apparatus is releasably mounted to the press, and can be pivoted about a lower axis to bring the applicator roll into and out of contact with the blanket roll of the press.

6 Claims, 5 Drawing Figures

PRINTING COATER

BACKGROUND OF THE INVENTION

1. Field of the Invention

This invention relates to offset lithographic printing, and more particularly to apparatus for attachment to the down-stream end of an offset lithographic printing press, for coating purposes.

In offset lithographic printing, each printing stage includes a plate cylinder, to which the printing plates are fastened tightly around the circumference, the plate cylinder being equipped with superimposed inking, watering and wiping mechanisms. The plate cylinder does not come into contact with the paper to be printed, but transfers the image to an intermediate blanket cylinder, which has a specially composed smooth, rubber blanket surface. The blanket cylinder, having received the impression from the plate cylinder, in turn transfers it, or offsets it, onto the paper or other material, whilst it is being carried around an impression cylinder, located out of contact with the plate cylinder. Lithographic inks are oil-based, and special precautions normally need to be taken to dry the inks after their application to the printed material, as rapidly as possible without spoiling the quality of the printing, so that the printed material can be subsequently handled and stacked without damaging the applied printing.

2. Brief Description of the Prior Art

An alternative to conventional drying of printed sheets issuing from a lithographic printing press, is coating of the printed sheet with a water-borne system, to provide either a gloss or dull coating. Water-borne coatings, applied as an aqueous solution or emulsion, are capable of providing a simple protective barrier for the ink, which eliminates the need for the application of spray powder for drying purposes, and protects the ink from abuse whilst its normal setting and oxidation functions proceed. Much development with water soluble polymers has been undertaken in the last few years, to produce acceptable coatings for this purpose. When properly applied, the film is permeable and permits the passage therethrough of oxygen, to permit the normal setting and drying of the ink. In addition to this function of protecting printing inks after application to permit their proper drying, water-borne coatings can perform a useful decorative function to enhance the appearance of high quality, multi-colour printing work, for example phonograph record sleeves.

If the coating of printed material is conducted in a separate operation, after the material has been removed and isolated from the printing press, the operation is expensive and inconvenient, and does not contribute to the solution of the ink drying problems. It is known to apply water-borne and organic solvent lacquers in a separate operation from the printing, to provide special, decorative finishes. The use of solvent based lacquers introduces fire and explosion hazards.

There is a need in the industry for a simple and economical apparatus for application of water-based polymer coatings to printed material immediately after the printing thereof, i.e. in-line coating with the lithographic offset press.

SUMMARY OF THE INVENTION

It is an object of the present invention to provide a novel apparatus for inline coating of printed material issuing from an offset lithographic printing press.

It is a further object of the invention to provide such an apparatus which can be releasably secured to an existing offset lithographic printing press, and operated in conjunction therewith without requiring substantial modification of the printing press itself.

The present invention provides an apparatus for application of coatings to printed material, in the form of an attachment to be applied to the downstream end of a conventional offset lithographic printing press. The apparatus is releasably mountable in position so as to apply a liquid coating composition to the blanket cylinder of the final stage of an offset press, the apparatus including an applicator roller which can bear against the surface of the blanket cylinder and rotate therewith, a pick-up roller which applies coating composition to the applicator roller for transfer to the blanket cylinder, and a reservoir of coating composition in which the pick-up roller runs, to obtain its source of coating material. The entire apparatus is constructed as a unit, for application and use with a standard printing press as and when required, and removable therefrom when not in use. It is merely necessary to disconnect the normal liquid supply train associated with the final stage of the press, without even physically removing it from the press, in order to use the apparatus according to the present invention along with a conventional press.

Thus according to one aspect of the present invention, there is provided an in-line coating apparatus for attachment to and use in conjunction with an offset lithographic printing press which has a final stage including a rotatable blanket cylinder and a rotatable impression cylinder, said apparatus being adapted for continuous surface coating of items printed by said press, said coating apparatus comprising:

a reservoir structure for receiving liquid coating compositions;

a cylindrical pick-up roller adapted to receive on its surface coating composition from said reservoir structure as it rotates;

a cylindrical applicator roller mounted to rotate with its surface contacting the rotating surface of said pick-up roller so as to transfer liquid coating composition from the pick-up roller to the applicator roller;

drive means for rotatably driving at least one of said pick-up roller and said applicator roller;

releasable mounting means for releasably securing said apparatus to the downstream end of said offset printing press, said mounting means being adapted to secure the apparatus to the press with surface contact between the applicator roller and the final stage blanket cylinder of said press.

From another aspect, the present invention provides an offset lithographic printing press having a plurality of liquid applicator stages, each including a rotatable blanket cylinder and a rotatable impression cylinder, said press including an in-line coating apparatus secured to the down-stream end thereof and operable in conjunction with the blanket cylinder of the final, downstream stage thereof, the coating apparatus including:

a reservoir structure for receiving liquid coating compositions;

a cylindrical pick-up roller adapted to receive on its surface coating composition from said reservoir structure as it rotates;

a cylindrical applicator roller mounted to rotate with its surface at one location contacting the rotating surface of said pick-up roller so as to transfer liquid coating composition from the pick-up roller to the applicator roller, said cylindrical applicator roller also mounted to rotate with its surface at the second location contacting the rotating surface of the blanket cylinder of the final stage of the press;

drive means for rotatably driving at least one of said pick-up roller and said applicator roller.

DESCRIPTION OF THE PREFERRED EMBODIMENTS

A conventional offset lithographic printing press has at least two stages, and may have four or five stages, when the machine is used for printing several colours. The final stage of such a printing press normally includes a plate cylinder, a blanket cylinder and an impression cylinder, mounted substantially vertically one above the other, with a varnish trough and a train of vertically mounted rollers from the varnish trough downwardly to the plate cylinder, for applying varnish to the printed work as it proceeds out of the printing press. The apparatus according to the present invention is particularly well suited for securing to a printing press of this type. It is then merely necessary to disconnect the roller train between the varnish trough and the plate cylinder, e.g. by removing or displacing one of the rollers of said train, and the apparatus of the present invention can be used in its stead. The apparatus is equally applicable to a final ink-applying stage of an offset press, in similar manner.

Preferably also, the apparatus according to the invention includes a metering roller mounted adjacent to the surface of the pick-up roller, at a location where its surface carries the coating composition to transfer to the applicator roller, so that the metering roller may limit the quantity of coating composition carried by the pick-up roller. It is of advantage also to make the position of the metering roller adjustable, so that the amount of coating applied can be adjusted thereby.

Also according to a preferred embodiment, the apparatus is pivotally mounted with respect to the frame of the printing machine, and is pivotal about a generally horizontal axis located below the level of the blanket cylinder of the press and the pick-up roller of the coating apparatus. Then the apparatus can be pivoted towards and away from the end of the printing press, to put the applicator roller into contact with the blanket cylinder for operating purposes, and to move the applicator roller out of contact with the blanket cylinder, when it is not required to use the coating attachment according to the invention. Such an arrangement greatly enhances the versatility of the resulting printing press, allowing it to be used in conventional manner as well as in application of coating by the apparatus of the invention.

BRIEF REFERENCE TO THE DRAWINGS

In the drawings, like reference numerals indicate like parts.

DETAILED DESCRIPTION OF THE SPECIFIC PREFERRED EMBODIMENT

Figure 1:
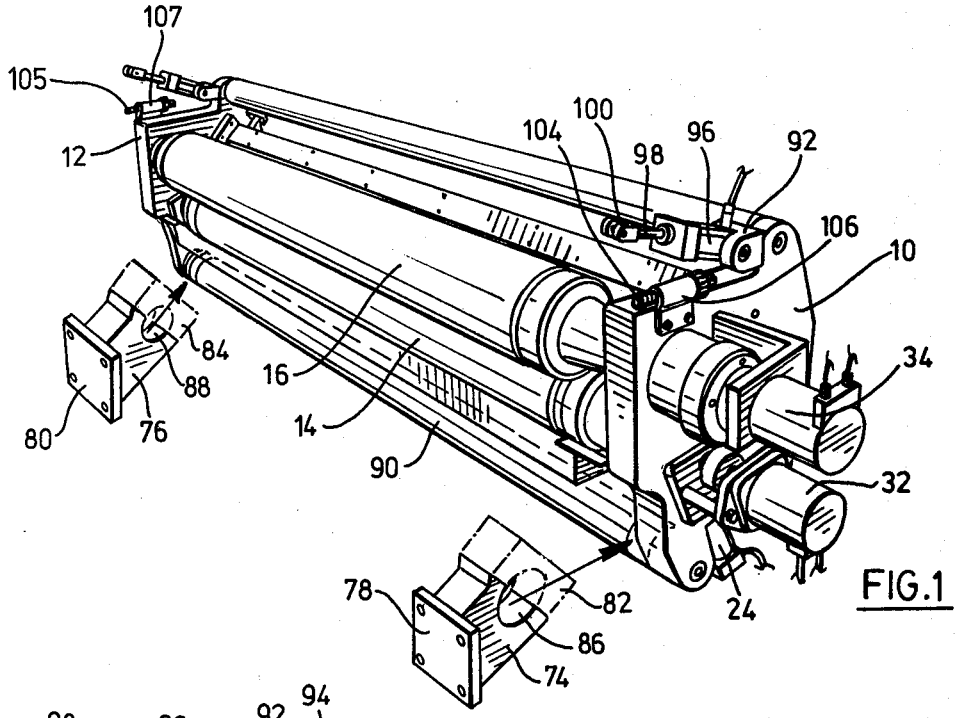
FIG. 1 is a perspective view of an in-line coating apparatus according to the present invention.
Figure 2:
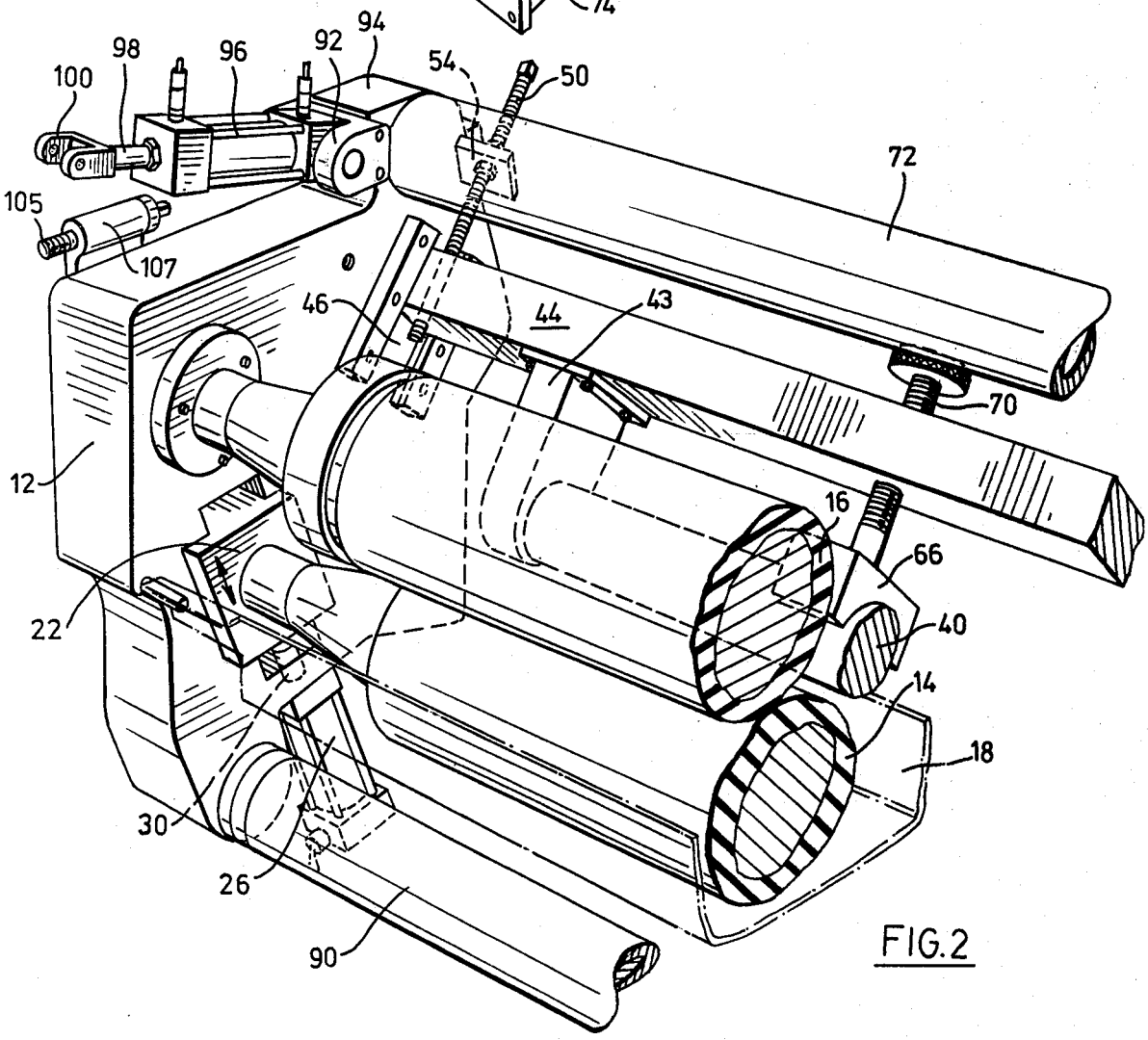
FIG. 2 is a detailed perspective view of the first, left-hand end of the apparatus of FIG. 1.
Figure 3:
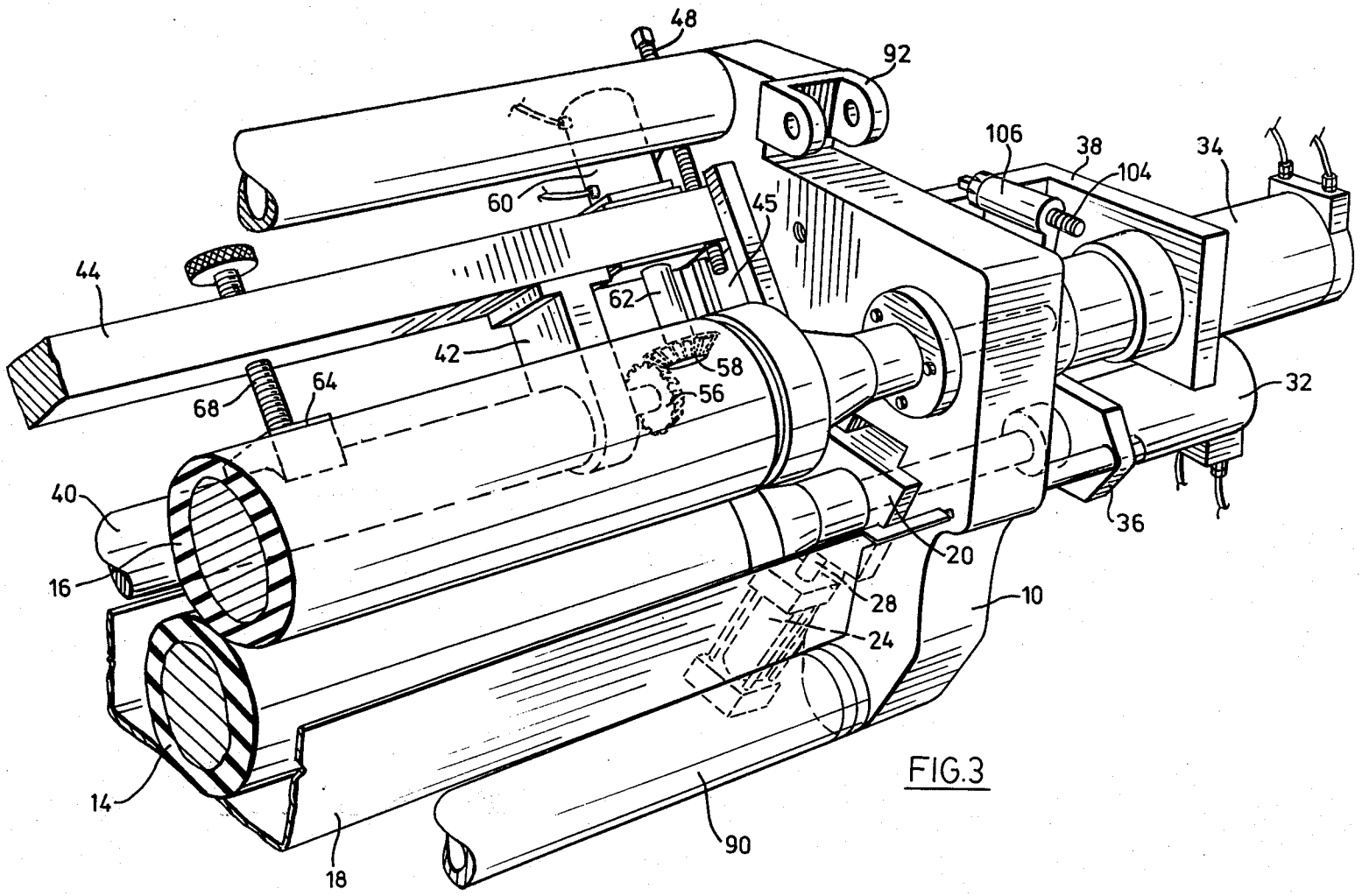
FIG. 3 is a detailed perspective view of the second, right-hand end of the apparatus of FIG. 1.

With respect to the drawings, and especially to FIGS. 1, 2 and 3 thereof, an in-line coating apparatus especially for applying water-borne liquid coating compositions to printed sheet or web material, comprises a pair of similar end frame members 10, 12 in which are journalled shafts of the cylindrical pick-up roller 14 and a cylindrical applicator roller 16, mounted above the pick-up roller 14. A reservoir structure in the form of an open-topped trough 18 is provided, in which coating liquid may be contained, and extending between the frame members 10, 12. The pick-up roller 14 is mounted to rotate in the trough 18. The applicator roller 16 and the pick-up roller 14 have surface contact near the top of the pick-up roller 14. The position of pick-up roller 14 is adjustable to a limited extent, towards and away from the applicator roller 16 and relative to the bottom of the trough 18, by slidable journal blocks 20, 22 slidably mounted in apertures in respective end frame members 10, 12. The journal blocks 20, 22 are positionally adjustable in end frame members 10, 12 by means of respective hydraulic cylinders 24, 26 with pistons 28, 30 protruding upwardly therefrom and passing upwardly through apertures in frame members 10, 12 to bear against the underside of the journal blocks 20, 22. The cylinders 24, 26 are connected to a suitable source of hydraulic power, not shown.

The shafts of the pick-up roller 14 and applicator roller 16 are each provided with respective hydraulic motors 32, 34, for rotational drive of the rollers. The motors 32, 34 are mounted in respective structural brackets 36, 38 protruding axially beyond side frame member 10 and secured thereto.

A cylindrical rotatable metering rod 40 is provided, extending parallel to the pick-up roller 14 and applicator roller 16, and rotatably mounted in bearing blocks 42, 43 one at each end of metering rod 40. The bearing blocks are securely bolted to a mounting bar 44 which at each end is slidably received in slideways 45, 46 on the inner surfaces of respective end frame members 10, 12. The slideways are directed radially towards the pick-up roller 14 so that the proximity of metering rod 40 to pick-up roller 14 is adjustable by adjusting the position of mounting bar 44 in slideways 45, 46. To effect this adjustment, screw shafts 48, 50 are provided, threadably engaging brackets such as 54, on respective end frame members 10, 12, and received in mounting bar 44. Metering rod 40 is driven for rotation by means of bevel gears 56, 58 and hydraulic motor 60 with drive shaft 62, mounted on mounting bar 44. The metering rod 40 is steadied and guided in its rotation by adjustable guide blocks 64, 66, the end, part cylindrical surface of which slidably engages the circumference of rod 40. The guide blocks 64, 66 ensure an even coating thickness across the width of the press. They serve to minimize coating thickness variance caused by roller sag along its considerable length, or deflection thereof due to mechanical problems. The guide blocks 64, 66 are mounted on the end of respective screw threaded bolts 68, 70 threadably received in apertures in mounting bar 44. Above the mounting bar 44, there is provided a tubular strengthening rail 72 extending between end frame members 10, 12.

Figure 4:
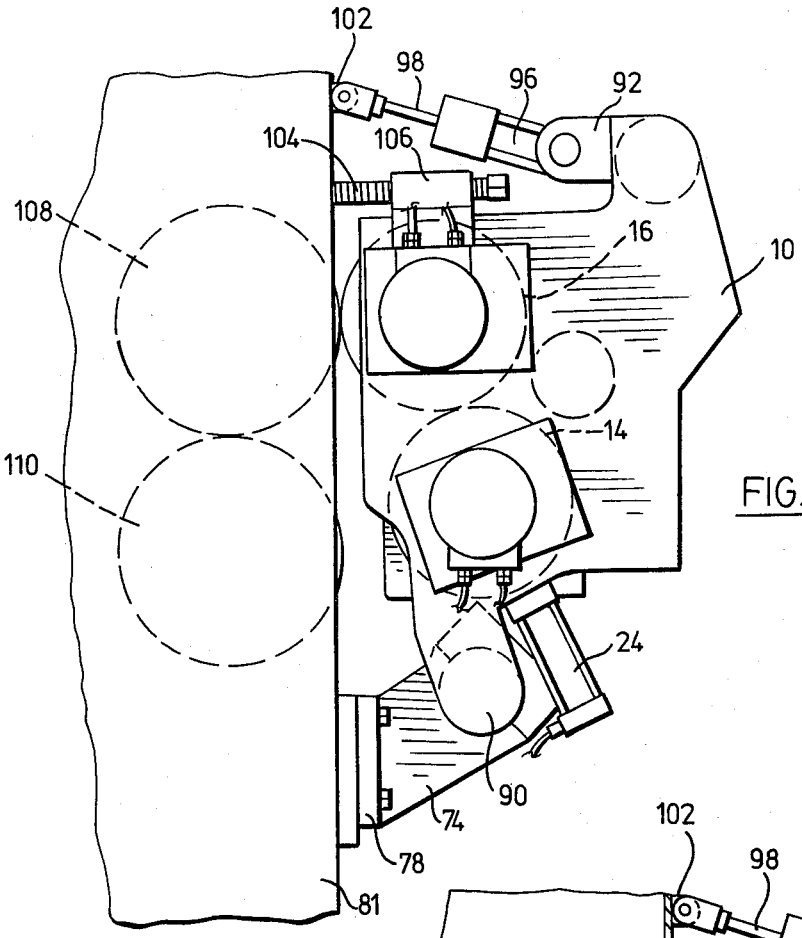
FIG. 4 is an end view of the apparatus of FIG. 1, taken from beyond the left-hand end thereof.
Figure 5:
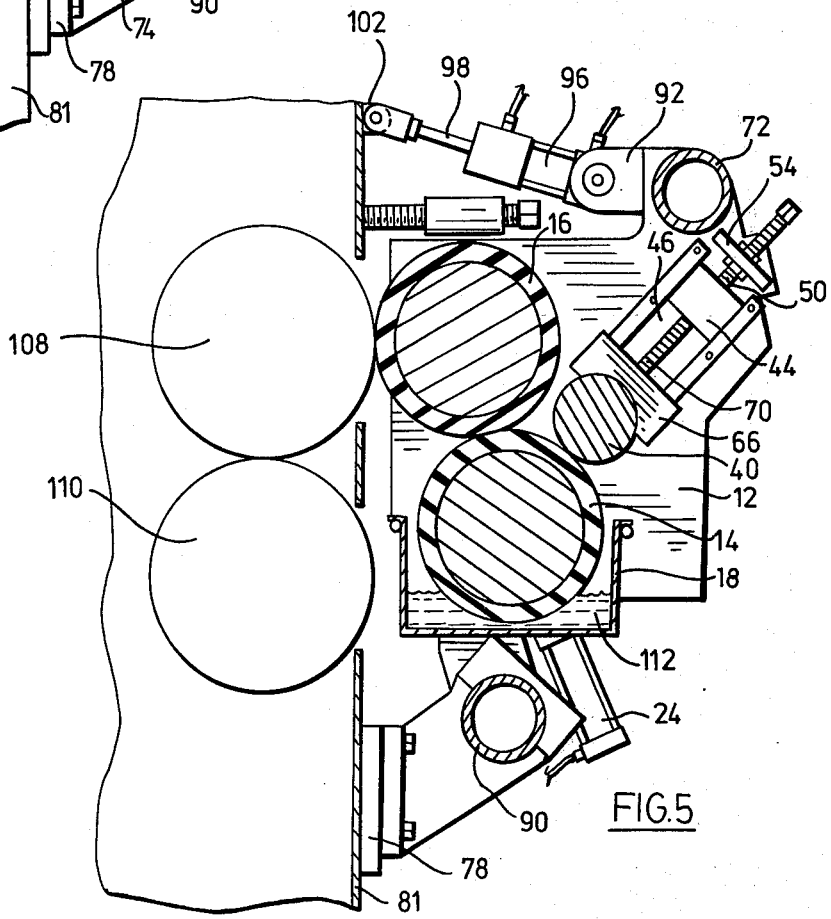
FIG. 5 is a vertical cross-sectional view of the apparatus of FIG. 4.

The mounting means for releasably securing the coating apparatus to the downstream end of an offset printing press comprises a pair of similar clamps 74, 76 each provided with a plate 78, 80 to be bolted to upright end frames 81 of a printing press (FIGS. 4 and 5). Each clamp 74, 76 has a respective removable block 82, 84 defining a circular aperture 86, 88. There is provided a cylindrical mounting rod 90 on the apparatus, extending between the end frame members 10, 12 at the lowermost part thereof. The mounting rod 90 is received in circular apertures 86, 88 in the clamps to form a pivotal connection of the apparatus to the press at this lowermost part.

At its upper part, the apparatus is connected to the press by means of a pair of length adjustable linkages, one attached to each end of frame member 10, 12. Each linkage comprises a yoke 92 secured to an uppermost protrusion 94 on the respective end frame member 10, 12 (see especially FIG. 2), the yoke 92 having pivotally secured thereto a hydraulic cylinder 96 and piston 98, the end of piston 98 having a bifurcated formation 100 for pivotal securing to a bracket 102 on the end frame 81 of the press. Thus hydraulic cylinder 96 can be pressurized to extend piston 98 and cause pivoting of the coating apparatus relative to the frame 81 of the press, about the inner horizontal axis provided by the mounting rod 90. The forwardmost position of the pivoting movement of the apparatus towards the press frame 81 is limited, to an adjustable extent, by a stop means comprising a pair of bolts 104, 105 threadably received in respective threaded sleeve mounts 106, 107, one at each end frame member 10, 12 at the top surface thereof, the bolts 104, 105 protruding axially towards the end frame 81 of the press.

The mounting and operation of the apparatus of the present invention will be apparent from the foregoing description and particularly with reference to FIGS. 4 and 5 of the accompanying drawings. The apparatus is mounted in position on the end frame 81 of an offset lithographic printing press, the final, downstream stage of which includes a blanket cylinder 108 and impression cylinder 110, between which printed material is fed. The mounting is accomplished using releasable clamps 74, 76 pivotally engaging mounting rod 90, and by connecting bifurcated formations 100 on piston rods 98 to brackets 102. Coating liquid 112 is introduced into trough 18. The relative position of pick-up roller 14, applicator roller 16 and metering rod 40 are adjusted to provide the pick-up and transfer of coating liquid 12 in the desired amount. Hydraulic cylinders 96 are contracted to pivot the apparatus about rod 90 and bring applicator roller 16 into light surface contact with blanket cylinder 108 of the press. The contact pressure is limited by presetting the position of stop bolts 104, 105 in their respective sleeves 106, 107, to engage the end frame 81 of the press at the desired position. This prevents undue pressure on and consequent damage to the surface of the blanket cylinder 108. The various drive motors for the apparatus are activated to drive the rollers etc. at the desired speed to match that of the press. Coating liquid 112 is picked up from trough 18 by pick-up roller 14, metered by rod 40, transferred to applicator roll 16 by surface contact therewith, and thence similarly to the blanket cylinder 108 of the press to coat sheets printed by and issuing from the downstream end of the press. When it is desired to interrupt the application of coating, the hydraulic cylinders 96 may be pressurized to pivot the apparatus about rod 90, clockwise with reference to FIGS. 4 and 5, and bring applicator roller 16 out of surface contact with blanket cylinder 108. The printing press conventionally has a liquid trough and train of smooth surface transfer rollers located above the blanket cylinder and plate cylinder (not shown) thereof, for supply of other liquids such as varnishes to the printed sheet via the blanket cylinder. When the apparatus according to the invention is moved to its operative position shown in FIGS. 4 and 5, the conventional liquid application is rendered inoperative by interrupting the liquid supply roller train thereof. The conventional system can readily be replaced and used when the apparatus of the invention is not to be employed and is pivoted to its inoperative position or removed entirely from the press.

The apparatus according to the present invention thus provides a simple and versatile in-line coating means for use with conventional, standard offset lithographic printing presses. It is well suited for the application of water-based polymer coatings to newly printed work, to protect the ink thereon whilst it sets and hardens. It requires a minimum of modifications to the standard press and easily installed as an "add-on" item. It does not interfere with sheet feed and collection apparatus of the press, and can be used with conventional dryers if desired. Once installed it can be moved to an inoperative position simply and easily without total removal from the press if desired, and the press restored to its full conventional operation.

Whilst a specific preferred embodiment of an apparatus according to the invention has been described and illustrated in detail herein, it will be appreciated that this is for illustrative purposes only and is not to be construed as limiting. Many variations of standard parts, e.g. use of alternative drive means and power actuation means, will readily occur to those skilled in the art. The scope of the invention is defined by the appended claims.

What we claim is:

1. An in-line coating apparatus for attachment to and use in conjunction with an offset lithographic printing press which has a final printing stage including plate, blanket and impression cylinders, said blanket cylinder engaging with said impression cylinder to print a sheet passing between the blanket and impression cylinders, said apparatus being adapted for continuous surface coating of items printed by said press and passing in contact with said blanket cylinder of the final printing stage thereof, the coating apparatus comprising:

a reservoir structure for receiving liquid coating compositions;

a cylindrical pick-up roller adapted to receive on its surface coating composition from said reservoir structure as it rotates;

a cylindrical applicator roller mounted to rotate with its surface contacting the rotating surface of said pick-up roller so as to transfer liquid coating composition from the pick-up roller to the applicator roller;

drive means for rotatably driving at least one of said pick-up roller and said applicator roller;

releasable mounting means to mount said apparatus adjacent the blanket cylinder of said final printing stage of said printing press, said mounting means being effective to secure the apparatus to the press and including control means for moving the applicator roll independently of said blanket cylinder so that the blanket cylinder remains in engagement with said impression cylinder, between a first, operative position in which said applicator roll is in engagement with the blanket cylinder of the final printing stage of said press and a second, inoperative position in which said applicator roll is disengaged from said blanket cylinder, said control means constituting means permitting said final stage optionally to be used as a printing stage and as a coating stage.

2. The apparatus of claim 1 further including a metering roller mounted adjacent to the surface of the pick-up roller at a location where said surface carries coating composition to transfer to the applicator roller, said metering roller being adapted to limit the quantity of coating composition carried by the pick-up roller.

3. The apparatus of claim 2 wherein the metering roller is positionally adjustable, towards and away from the pick-up roller.

4. The apparatus of claim 3 including adjustment means for adjusting the relative positions of the pick-up roller and the applicator roller, to vary the surface contact pressure therebetween.

5. The apparatus of claim 1 wherein the releasable mounting means is a pivotal mounting means comprising a lower pivot mount for releasably attaching to a lower part of the frame of the printing press, said lower pivot mount being disposed below the pick-up roller and applicator roller, and an upper mount for releasable attachment to a higher part of the frame of the printing press, said upper mount being disposed above the applicator roller and comprising a length adjustable linkage, the length of said linkage being adjustable in a direction towards and away from the end of the printing press to cause pivoting of the apparatus relative to the printing press about said lower pivot mount, thereby bringing the applicator roller into and out of operative contact with the blanket cylinder of said printing press.

6. The apparatus of claim 5 also including an adjustable stop means mounted on the upper part thereof, adapted to engage the end frame of the printing press to limit the pivoting movement of the apparatus towards the end of the printing press when the applicator roller is brought into contact with the blanket cylinder.

* * * * *